United States Patent [19]

Long et al.

[11] Patent Number: 4,892,243

[45] Date of Patent: Jan. 9, 1990

[54] AIR-BEARING CENTER-GUIDING APPARATUS AND METHOD

[75] Inventors: Michael Long; Thomas W. Palone, both of Rochester; Paul Kemp, Churchville, all of N.Y.

[73] Assignee: Eastman Kodak Company, Rochester, N.Y.

[21] Appl. No.: 247,224

[22] Filed: Sep. 21, 1988

[51] Int. Cl.[4] ..... B65H 23/24; B65H 23/32

[52] U.S. Cl. ..... 226/97; 226/196; 226/197

[58] Field of Search ..... 226/7, 15, 97, 196, 226/197; 242/76; 384/12, 100

[56] References Cited

U.S. PATENT DOCUMENTS

| | | | |
|---|---|---|---|
| 3,156,398 | 11/1964 | Lauxen et al. | 226/97 |
| 3,971,496 | 7/1976 | Karsh | 226/97 X |
| 4,288,015 | 9/1981 | Curtin | 226/97 |
| 4,336,900 | 6/1982 | Pontoni | 226/97 |
| 4,474,320 | 10/1984 | Rueger | 226/7 X |

FOREIGN PATENT DOCUMENTS

| | | | |
|---|---|---|---|
| 726992 | 2/1966 | Canada | 226/7 |

*Primary Examiner*—John Petrakes

*Assistant Examiner*—Phillip S. Han

*Attorney, Agent, or Firm*—Charles E. Snee, III

[57] ABSTRACT

An air-bearing center-guiding apparatus 10 and a method are disclosed for supporting and laterally center-guiding thin flexible webs of paper or plastic under 15 mils in thickness. The apparatus comprises a web support and guide member 22 having an inner surface and an outer web-facing surface. Parallel rows of elongated spaced-apart guide apertures 34 extend longitudinally along edge regions of the web. Each guide aperture 34 is formed from a cylindrical opening in the web support and guide member 22 and extends substantially perpendicular to the web. Within each aperture a flat-sided dowel 60 is mounted to define a flow passage shaped in cross-section like a segment of a circle 62. Each circular-segment guide aperture 34 has a straight side 54 and a curved side 52 for directing a jet of air against the web edge 56. A plurality of the circular-segment guide apertures 34 develop a guiding force for holding lateral movement of the web to plus or minus 0.001 inch (0.0254 mm). A row of web-support apertures 32, separate from the guide apertures 34, is provided between the rows of guide apertures 34 to form an air bearing for supporting the web.

22 Claims, 3 Drawing Sheets

FIG. 1
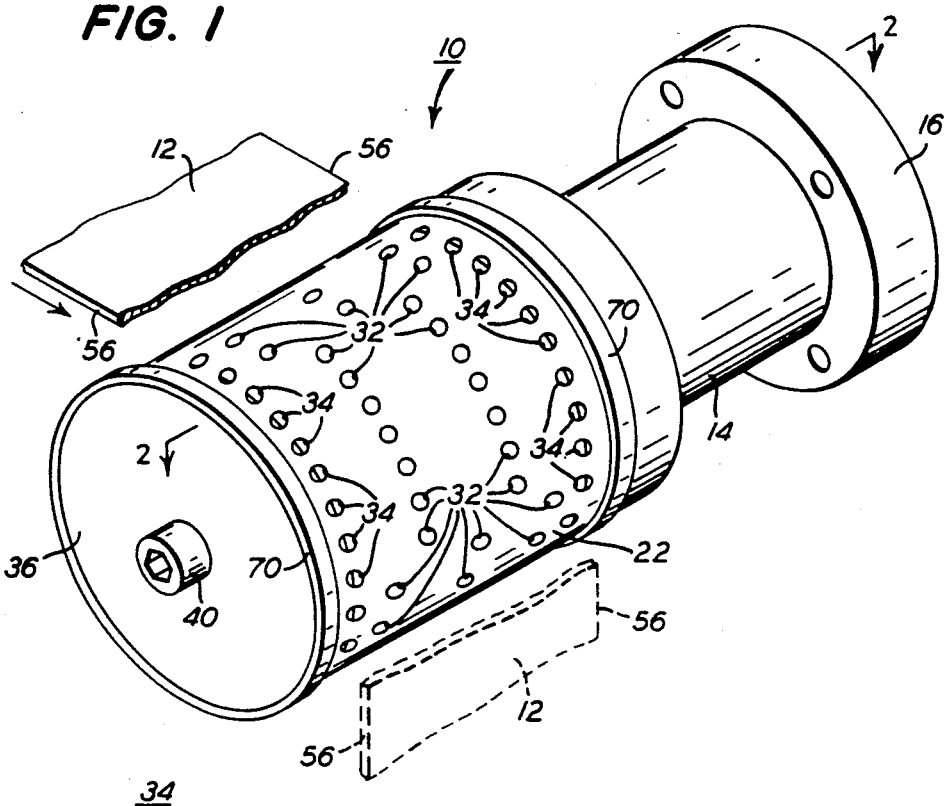
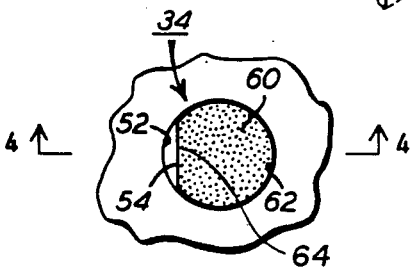
FIG. 3
FIG. 5
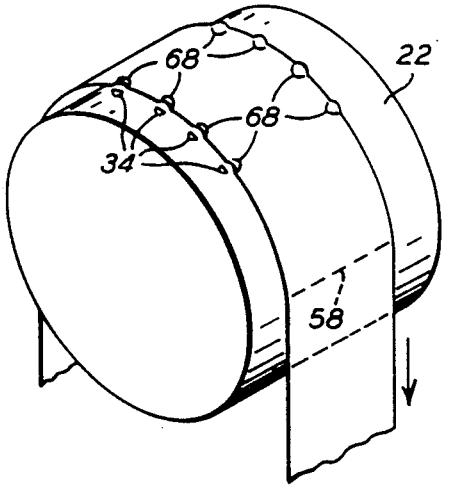
FIG. 4
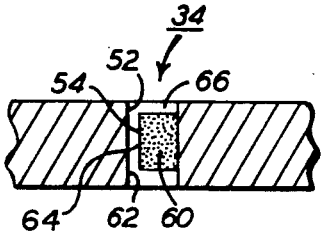

AIR-BEARING CENTER-GUIDING APPARATUS AND METHOD

CROSS-REFERENCE TO RELATED APPLICATIONS

This application relates to applicants' copending application Serial No. 254,341, entitled Web Center-Guiding Apparatus, filed concurrently herewith.

FIELD OF THE INVENTION

The present invention relates generally to web-guiding apparatus, and more particularly to an air-bearing center-guiding apparatus method for supporting and laterally center-guiding thin webs.

BACKGROUND OF THE INVENTION

Air-bearing center-guiding apparatus for supporting and laterally center-guiding webs are generally well-known in the art, of which the following U.S. Pat. Nos. 3,971,496, 4,197,972, 4,288,015 and 4,474,320 are exemplary. Although the apparatus described in these patents provide some lateral center-guiding of webs, the center-guiding force developed is negligible for small displacements when applied to guiding thin webs on the order of 15 mils or less in thickness.

Thus, the general object of the present invention is to provide an improved air-bearing center-guiding apparatus for supporting and guiding a thin web in a noncontacting manner, and particularly to provide guide apertures arranged along the web edges of a specially designed shape whereby a web-guiding force is developed for guiding a web along a central axis to a tolerance of plus or minus 0.001 inch (0.0254 mm).

SUMMARY OF THE INVENTION

The objects of this invention are accomplished by providing an air-bearing center-guiding apparatus and method for supporting and laterally center-guiding thin webs comprising:

a web support and guide member having an inner surface and an outer web-facing surface;

the outer peripheral surface, the air-directing means comprising (1) a pair of parallel, longitudinally extending rows of elongated guide apertures in which the guide apertures are arranged in spaced-apart relation in each row, the rows being laterally spaced apart a distance substantially equal to the width of the web being guided, and wherein each of the elongated guide apertures opens through the outer peripheral surface in a direction substantially perpendicular to the surface of the web and defines in cross-section a flow passaged shaped like segment of a circle having a straight side and a curved side, and (2) web-support means separate from and interposed between the rows of guide apertures; and a source of pressurized air coupled to the web-support means for directing air therethrough to form an air cushion adjacent the web, and coupled to the guide apertures for directing air therethrough to laterally guide the web.

In a more specific embodiment of the invention, each straight side of a guide aperture is substantially in register with an edge of the web, and each curved side extends in a direction laterally outwardly of a longitudinally extending center line of the web.

In still another embodiment of the invention, the width of each guide aperture is approximately 6 mils and the length of each straight side is approximately 30 mils.

In still another embodiment of the invention, the web support and guide member over which the web is guided is a fixed arcuate member having a leading section, an intermediate section and a trailing section. A pair of parallel rows of support apertures extend circumferentially along the intermediate section, the support apertures being arranged in spaced-apart relation in each row. Additional flotation means, such as at least three parallel, rows of support apertures, extend circumferentially along the leading and trailing sections, the support apertures being arranged in spaced-apart relation in each row.

In a further embodiment of the invention, each of the guide apertures comprises a cylindrical opening in the web support and guide member extending through the outer surface thereof. A flat-sided dowel is mounted in the opening, with the flat side of the dowel defining the straight side of the circular-segment guide aperture.

In a further embodiment of the invention, the dowel has an outer end surface recessed a predetermined distance from the outer surface of the web support and guide member.

BRIEF DESCRIPTION OF THE DRAWINGS

In the detailed description of the invention presented below, reference is made to the accompanying drawings, in which:

FIG. 1 is a perspective view of a preferred embodiment of an air-bearing center-guiding apparatus of this invention;

FIG. 3 is an enlarged segmental top plan view of a guide aperture of the apparatus of FIG. 1;

FIG. 4 is a segmental view in section taken substantially along line 4—4 of FIG. 3;

FIG. 5 is a perspective view of an air-bearing center-guiding apparatus of this invention showing the web side-edge deformation in exaggerated form caused by air flow from the circular-segment guide apertures;

FIG. 6 is a graph showing the guiding force developed by an ideal guide aperture, a radial jet circular-segment guide aperture, and an angled jet guide aperture relative to web displacement from the longitudinal center line of the web; and FIG. 7 is a graph showing the relative efficiencies of the various shapes of guide apertures for producing a guiding force of roughly 1 gram per aperture.

DETAILED DESCRIPTION OF A PREFERRED EMBODIMENT

Figure 2:
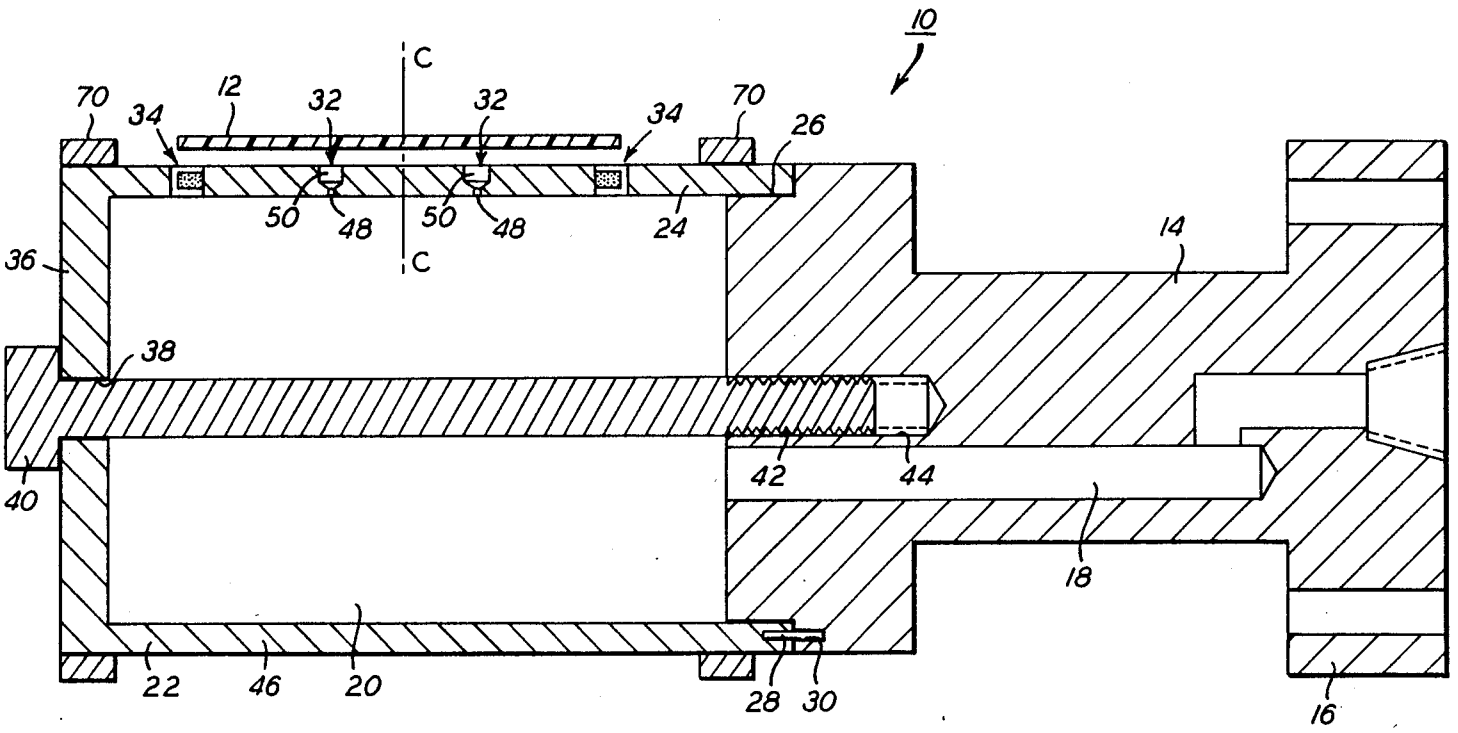
FIG. 2 is an enlarged section view taken through the axis of the apparatus of FIG. 1 substantially along line 2—2 of FIG. 1.

Because web-guiding apparatus are well-known in the art, the present description will be directed in particular to elements forming part of, or cooperating directly with, a web-guiding apparatus in accordance with the present invention. It is to be understood that elements not specifically shown nor described may take various forms well-known to those skilled in the art.

With reference to FIGS. 1 and 2, a preferred embodiment is disclosed of a noncontact apparatus or air bar 10 for supporting and laterally center-guiding a thin web 12. The apparatus comprises a cylindrical housing 14 having a flange 16 adapted to be rigidly secured to a fixed frame, not shown, by screws or the like. The housing 14 further has a passageway 18 through which air under pressure from any suitable air pressure source, not shown, is directed into a cavity 20 of the web-supporting and -guiding apparatus 10. The apparatus, as best seen in FIG. 2, comprises a cylindrical cup-shaped or arcuate member 22 having an open end 24 mounted on a cylindrical shoulder 26 of the housing. The open end 24 has an axially extending pin 28 which fits into a complementary opening 30 in the housing for positioning cup-shaped member 22 in a predetermined angular orientation relative to housing 14. In the predetermined angular orientation, web-support apertures 32 and guide apertures 34, respectively, are properly positioned for supporting and guiding web 12, shown only partially wrapped around cup-shaped or arcuate member 22, as seen in FIG. 1. A closed end 36 of cup-shaped or arcuate member 22 has an opening 38 through which a bolt 40 extends with threaded end 42 thereof in threaded engagement with a threaded blind bore 44 in the housing. The bolt 40 rigidly secures cup-shaped or arcuate member 22 to housing 14.

A cylindrical wall 46 of cup-shaped member 22 is provided with any suitable support means, such as a plurality of web-support apertures 32 radially extending from the inner surface thereof to an outer web-facing surface thereof, through which jets of air are directed from the cavity to support a thin web 12 on an air cushion of substantially 10 mils thickness. Alternatively, sections of wall 46 may be formed of porous material.

Each web-support aperture 32 preferably comprises an orifice 48 followed by an expansion region 50. The orifice 48 controls the flow while the expansion region 50 disperses the force of the air jet over a larger web area. It has been noted that the web-support air jets emitted from web-support apertures 32 negatively influence the web-guiding function, causing a tendency toward lateral instability which is a function of the shape and amplitude of the pressure distribution profile. The amplitude of the pressure distribution profile is determined by the air pressure supplied to web-support apertures 32. The shape of the pressure distribution profile is determined by the placement of the web-support apertures and represents a compromise between lateral stability and pressure uniformity. It was found that a single row of web-support apertures at the web center line, designated c—c in FIG. 2, created a sinusoidal jet pressure profile producing a small decentering force gradient. Moreover, such central positioned support jets lacked the pressure uniformity required to support webs with nonuniform tension distribution and widthwise web curl. Accordingly, a pair of rows of pressure apertures is used to increase the pressure uniformity, though slightly increasing the decentering force gradient which is proportional to the distance of the apertures from the web center line c—c.

The web-support apertures 32 are sized to accommodate the pressures required by the guide apertures of 20–30 pounds per square inch gage (psig). The size, placement and number of support apertures must meet the following conditions:

1. The shape and amplitude of the pressure distribution profile under the web must have a decentering tendency on the web much smaller than the centering force of the guide apertures 34.

2. Air must exit the web-support apertures 32 at a sufficient rate and pressure and be distributed so as to support the web 12 at a height sufficient to prevent camber, widthwise curl and nonuniform tension distributions from causing the web to contact the air bar under the applied web tension.

3. The pressure differential through the web-support apertures 32, and therefore the radial stiffness of the supporting air film or cushion, must be high enough to support the web despite dynamic tension transients.

These three conditions influence the design toward a large-diameter web-support guiding apparatus operating in the 20–30 psig range having numerous guide apertures 34 and numerous small-diameter web-support apertures 32 which are placed as close to the web center line c—c as permitted, given the web and tension nonuniformities of a particular application.

The web 12 is laterally center-guided without contact through jets of air issuing radially from guide apertures 34 arranged along side edges 56 of the web. The guide apertures 34 are angularly or circumferentially spaced apart along cylindrical wall 46 and radially extend from the inner peripheral surface to the outer peripheral surface of the wall. Each aperture 34 in cross-section has a curved side 52 extend beyond, and a straight side 54 substantially in register with, side edge 56 of the web. The radially extending guide apertures 34 of the aforementioned configuration create a very high centering force gradient which makes them capable of guiding thin webs 12 to within plus or minus a few mils and sets them apart from known web-guiding apparatus with angled guide jets, which typically have a low centering force gradient. The guide apertures 34 of this invention have demonstrated a centering force gradient of 200 grams per millimeter with a peak centering force of 15 grams. The centering force is a function of the shape, size, spacing and number of guide apertures 34, the pressure supplied to those apertures, the web porosity and stiffness, and the pressure profile of the air supporting the web. This profile consists of two components: (1) a low-pressure region of the web created by high-velocity air from the guide apertures 34 rushing past the edge of the web and (2) a positive pressure region under the web created by pressurized air jets from web-support apertures 32.

For webs which exhibit strong widthwise curl (such as most photographic films) and where even light contact between the web-guiding apparatus and the side edges 56 of the web is unacceptable, it is recommended that the apparatus support the web with the edges thereof curling away from the apparatus. Accordingly, for photographic films at humidities below 60 percent relative humidity, the emulsion surface should face away from the apparatus. This recommendation is based on the observation that the humidity of compressed air is generally not controlled or controlled only to the extent that it is "dry". This dry air blowing directly on the emulsion can dry it appreciably in a matter of seconds, causing considerable curl. If the emulsion surface were facing the web-guiding apparatus, it would become difficult to prevent the edges 56 of the web from contacting the apparatus, particularly at the entering and exiting web tangency lines 58, only one of which is shown dotted in FIG. 5 of the apparatus. The web tangency lines 58 extend widthwise of the web at right angles to the web edges and are located along the line where the web engages and departs from the outer periphery of the cylindrical cup-shaped arcuate member 22. If the emulsion surface faces away from the apparatus, drying effects are reduced and the system becomes relatively insensitive to web curl, making it practical to support and guide web 12 completely without contact.

As web tension is increased beyond normal operating levels, however, the first areas of web contact will be at the edges of the web at the entering and exiting web tangency lines 58. For this reason, any suitable aperture or pattern may be used in the area of these tangency lines, as seen in FIG. 1, to increase the volume or consumption rate of support air to counteract the extra air leakage at the tangency lines. The illustrated embodiment in FIGS. 1 and 4, for example, may comprise three axially spaced rows of two circumferentially spaced support apertures 32, with one row in register with the web center line c—c, and the other rows interposed between the guide apertures 34 and the innermost row of web-support apertures 32.

With specific reference to FIGS. 2, 3 and 4, the guide apertures 34 are formed by pressing a 0.0625-inch (1.5875-mm) diameter dowel 60 which is 0.10 inch (2.54 mm) long into radially extending cylindrical openings 62 in cylindrical wall 46. The dowels 60 are provided with flats 64 which cooperate with the inner periphery or curved side 52 of opening 62 to form circular-segment guide apertures 34 of this invention, as best seen in FIG. 3. The openings 62 are spaced apart widthwise such that the flat or straight side 54 of each guide aperture 34 is substantially in register with side edges 56 of web 12. The dowels 60 are pressed into openings 62, with a slight recess 66 at the upper end thereof to permit a larger quantity of air to be entrained in the guide jets of air. This greatly amplifies the guiding force of the relatively small amount of air exiting the circular-segment guide apertures 34. Recess 66 may be from 0.005 inch 0.05 inch in depth.

With reference to FIG. 5, it has been observed that a plurality of local uplifted deformations 68 of the web edges 56, each of substantially arcuate shape in radial and axial directions, accompanies a strong guiding-force effect. These local deformations 68 are not observed with very stiff webs, for example, 15-mil Estar (trademark of the Eastman Kodak Company) or 3-mil steel webs, and the guide jets of air provide virtually no guiding effect with such stiff webs. These local deformations 68 are also not present when air at a pressure of substantially 20 psig and an equal air consumption rate is directed through a continuous circumferential slit 78 (FIG. 7E) to form a continuous narrow ring of air, or through perpendicular cylindrical guide apertures 76 (FIG. 7D). The shape of the circular-segment guide apertures 34 has proven to be very important to the guiding force developed and the guiding-force gradient.

A high guiding-force gradient is required to guide a web 12 to tight axial tolerances relative to the longitudinally extending center line c—c (FIG. 2) of the web. The web-guiding apparatus of this invention is designed to guide a thin web 12 to a plus or minus 0.001-inch tolerance. With reference to FIG. 6, it has been observed that a radial jet from circular-segment guide apertures 34 of this invention will guide a web to plus or minus 0.001-inch tolerance, whereas angled jets produced by angled guide apertures typically have a guiding ability of approximately plus or minus 0.020-inch tolerance. In operation, it is observed that, when a web guided by the guiding apertures 34 of this invention is manually displaced from the center line c—c and released, it very crisply snaps back to the centered position without extensive overshoot or oscillation. It is believed that this is due to the radial jets of air emitted from the circular-segment guide apertures forming longitudinally spaced local deformations 68 of web edges 56, as shown in FIG. 5.

With reference to FIG. 7, for an equal air-consumption rate generating approximately 1 gram per aperture guiding force, the following relative guiding-force ratios were observed for the differently shaped guide apertures shown therein. The numbers indicated therein are related to the relative efficiencies of the various shapes at producing the 1-gram-per-aperture guiding force. As was observed, the circular-segment apertures 34 of this invention, in which the straight sides 54 thereof are substantially in register with web edges 56 (FIG. 7A), had an efficiency rating of 200 percent in developing the guiding force of roughly 1 gram per aperture. The next most efficient guide aperture shape is shown in FIG. 7B and involves a circular-segment shape 72 identical with, but reversely oriented relative to, the circular-segment shape shown in FIG. 7A. This is achieved by mounting dowels 60 in openings 62 with the dowels rotated through 180° from the position seen in FIG. 3, so that curved side 52 and straight side 54 are on the opposite sides of opening 62. With this guide-aperture design, the curved sides 52 are concave outwardly from the center line of the web; and the apexes of the curved sides 52 of the guide apertures, which are opposed to straight sides 54, are arranged substantially in register with side edges 56 of the web. That is, as seen in FIG. 7, the edge of the web is substantially tangent to the projected apexes of the curved side of the guide aperture 72, while the straight side 54 extends beyond the edge of the web. In FIG. 7C, radially extending, rectangular-shaped guide apertures 74 had an air efficiency rating of 80 percent, whereas radially extending, angled or perpendicular cylindrical guide apertures 76 and continuous slit-guide apertures 78, as shown in FIGS. 7D and E, respectively, had a negligible efficiency rating.

A plurality of the web-guiding apparatus or air bars may be used together to support and guide endless webs. In such applications, the cup-shaped member 22 may be provided with any suitable guide rings 70 (FIGS. 1 and 2) to allow an operator to readily train the web around the cup-shaped members of the air bars. The guide rings 70 encircle the cup-shaped member and may be secured thereto by any suitable detents or clamp means, not shown.

What is claimed is:

1. A method for supporting and laterally center-guiding a thin web along a longitudinally extending web center line wherein the web has longitudinally extending side edges defining a predetermined web width, comprising the steps of:

providing a web-support member having an outer web-facing surface;

providing a pair of parallel, longitudinally extending rows of elongated guide apertures extending through said web-facing surface, said guide apertures being arranged in longitudinally spaced-apart relation in each row, said rows being laterally spaced apart a distance substantially equal to the predetermined width of the web being guided, each guide aperture further extending through said web-facing surface in a direction substantially perpendicular to the web and defining in cross-section an elongated aperture having a straight side and a curved side with one of said sides substantially in register with a side edge of said web and the other of said sides extended beyond said side edge, whereby each said elongated guide aperture is positioned substantially beyond said width of said web;

providing web-support means separate from and interposed between said rows of guide apertures; and directing a source of pressurized air (1) to said web-support means for forming an air cushion below the web for supporting the web on the air cushion and (2) to said elongated guide apertures for directing jets of air against the web edges for forming localized web-guiding deformations on the web edges for laterally center-guiding the web along the web center line.

2. A method for supporting and laterally center-guiding a thin web according to claim 1, comprising the step of arranging said elongated guide apertures so that the straight sides thereof are substantially in register with the web edges and the curved sides thereof are curved convexly outwardly from the center line of the web.

3. A method for supporting and laterally center-guiding a thin web according to claim 1, comprising the step of arranging said elongated guide apertures so that the curved sides thereof are curved concavely outwardly from the center line of the web with the apexes of the curved sides thereof substantially in register with the web edges.

4. A method according to one of claims 1–3, further comprising the step of shaping said curved side as a segment of a circle.

5. An air-bearing center-guiding apparatus for supporting and laterally center-guiding a thin web along a longitudinally extending web center line, wherein the web has longitudinally extending side edges defining a predetermined web width, comprising:

a web support and guide member having an outer web-facing surface;

air-directing means extending through said web-facing surface, the air-directing means comprising (1) a pair of parallel, longitudinally extending rows of elongated guide apertures, said guide apertures being arranged in longitudinally spaced-apart relation in each row, said rows being laterally spaced apart a distance substantially equal to the width of the web being guided, each guide aperture further extending substantially perpendicular to the web and defining in cross-section an elongated aperture having a straight side and a curved side with one of said sides substantially in register with a side edge of said web and the other of said sides extended beyond said side edge, whereby each said elongated guide aperture is positioned substantially beyond said width of said web; and (2) web-support means separate from and interposed between said rows of guide apertures; and a source of pressurized air coupled to said web-support means for directing air therethrough to form an air cushion below the web, and coupled to said guide apertures for directing air therethrough to laterally center-guide the web.

6. An air-bearing center-guiding apparatus according to claim 5, wherein said straight sides of said guide apertures are in register with the side edges of the web.

7. An air-bearing center-guiding apparatus according to claim 6, wherein said curved sides of said guide apertures are curved convexly outwardly from the longitudinally extending center line of the web.

8. An air-bearing center-guiding apparatus according to claim 4, wherein said curved sides of said guide apertures are curved concavely outwardly from the longitudinally extending center line of the web, with the apexes of the curved sides thereof substantially in register with the web edges.

9. An air-bearing center-guiding apparatus according to claim 5, wherein the webs supported and guided are flexible webs of paper and plastic of a thickness under substantially 15 mils.

10. An air-bearing center-guiding apparatus according to claim 5, wherein the width of each guide aperture is substantially 6 mils and the length of each straight side is substantially 30 mils.

11. An air-bearing center-guiding apparatus according to claim 5, wherein said web-support means comprises a plurality of support apertures located substantially along the longitudinally extending center line of the web.

12. An air-bearing center-guiding apparatus according to claim 5, wherein said web support and guide member comprises a fixed arcuate member having a leading section, an intermediate section and a trailing section, and wherein said web-support means comprises a pair of parallel, longitudinally extending rows of support apertures provided in the intermediate section for generating a predetermined volume of support air, said support apertures being arranged in spaced-apart relation in each row, and at least three parallel, longitudinally extending rows of further support apertures provided in said leading and trailing sections for generating a volume of support air greater than the predetermined volume, said further support apertures being arranged in spaced-apart relation in each row.

13. An air-bearing center-guiding apparatus according to claim 12, wherein the pair of rows of support apertures are located parallel to and on each side of the longitudinally extending center line of the web.

14. An air-bearing center-guiding apparatus according to claim 5, wherein said web support and guide member comprises a base member having a cylindrical shoulder, a cup-shaped member having a cylindrical body and an open end mounted on the cylindrical shoulder, and means are provided for securing the cup-shaped member to the base member.

15. An air-bearing center-guiding apparatus for supporting and laterally center-guiding a thin web along a longitudinally extending web center line, the web comprising longitudinally extending side edges defining a predetermined web width, said apparatus comprising:

a web support and guide member having an outer web-facing surface;

air-directing means extending through said web-facing surface and comprising (i) a pair of parallel, longitudinally extending rows of elongated guide apertures, said guide apertures being arranged in longitudinally spaced-apart relation in each row, said rows being laterally spaced apart a distance substantially equal to the width of the web, each said guide aperture extending substantially perpendicular to the web and defining in cross-section an elongated aperture having a straight side and a curved side, each said elongated aperture comprising a cylindrical opening in said web-facing surface and a flat-sided dowel mounted in said opening with the flat side thereof defining said straight side, one of said sides being substantially in register with a side edge of the web and the other of said sides being extended beyond such side edge, whereby each said elongated aperture is positioned substantially outside the width of the web; and (ii) web-support means separate from and interposed between said rows of guide apertures; and a source of pressurized air coupled to said web-support means for directing air therethrough to form an air cushion below the web and to said guide apertures for directing air therethrough to laterally center-guide the web.

16. An air-bearing center-guiding apparatus according to claim 15, wherein said dowel has an outer end surface recessed a predetermined distance from said web-facing surface.

17. An air-bearing center-guiding apparatus according to claim 16, wherein said predetermined distance is in the range of 0.005 to 0.050 inch.

18. An air-bearing center-guiding apparatus for supporting and laterally center-guiding a thin web along a longitudinally extending center line, the web comprising longitudinally extending side edges defining a predetermined web width, said apparatus comprising:

a web support and guide member including a base member with a cylindrical shoulder; a cup-shaped member having a cylindrical body, an open end mounted on said cylindrical shoulder and an outer web-facing surface; and means for securing said cup-shaped member to said base member;

air-directing means extending outwardly through said web-facing surface and comprising (i) an pair of parallel, longitudinally extending rows of elongated guide apertures, said guide apertures being arranged in longitudinally spaced-apart relation in each row, said rows being laterally spaced apart a distance substantially equal to the width of the web, each guide aperture extending from the interior of said cup-shaped member and substantially perpendicular to the web and defining in cross-section an elongated aperture having a straight side and a curved side, each said elongated aperture comprising a cylindrical opening and a flat-sided dowel mounted in said opening, with one of said sides substantially in register with a side edge of the web and the other of said sides being extended beyond such side edge, whereby each said elongated aperture is positioned substantially outside the width of the web; and (ii) web-support means separate from and interposed between said rows of guide apertures; and a source of pressurized air coupled to said web-support means for directing air therethrough to form an air cushion below the web and to said guide apertures for directing air therethrough to laterally center-guide the web.

19. An air-bearing center-guiding apparatus according to claim 18, wherein the width of each guide aperture is substantially 0.006 inch and the length of each straight side is substantially 0.030 inch.

20. An air-bearing center-guiding apparatus according to claim 19, wherein said dowel is recessed below said web-facing surface from 0.005 to 0.050 inch.

21. An air-bearing center-guiding apparatus according to claim 20, wherein the web engages said cylindrical body at a leading tangency line, wraps around a portion of said cylindrical body and leaves said cylindrical body at a trailing tangency line; and said web-support means comprises two longitudinally extending rows of support apertures interposed between said rows of guide apertures in the wrapped-around portion of said cylindrical body for providing a predetermined volume of support air, and three rows of further support apertures interposed between said rows of guide apertures for generating at said leading and trailing tangency lines a volume of support air greater than said predetermined volume.

22. An air-bearing center-guiding apparatus according to one of claims 5–13, 14 or 15–20, wherein said curved side is shaped as a segment of a circle.

* * * * *

UNITED STATES PATENT AND TRADEMARK OFFICE

CERTIFICATE OF CORRECTION

PATENT NO. : 4,892,243

DATED : January 9, 1990

INVENTOR(S) : Michael Long, Thomas W. Palone and Paul Kemp

It is certified that error appears in the above-identified patent and that said Letters Patent is hereby corrected as shown below:

Column 1, line 43, before "the outer peripheral surface," insert --air-directing means extending through--.

Signed and Sealed this

First Day of January, 1991

*Attest:*

*Attesting Officer*

HARRY F. MANBECK, JR.

*Commissioner of Patents and Trademarks*